US005938391A

United States Patent [19]

Allen

[11] Patent Number: 5,938,391

[45] Date of Patent: Aug. 17, 1999

[54] ADJUSTABLE PANEL INSTALLATION ASSEMBLY

[76] Inventor: Frederick Allen, 19 Harteshorne Rd., Wayside, N.J. 07712

[21] Appl. No.: 09/137,046

[22] Filed: Aug. 20, 1998

[51] Int. Cl.[6] ..... E04F 21/18

[52] U.S. Cl. ..... 414/11; 248/351

[58] Field of Search ..... 248/351, 354.1; 414/11

[56] References Cited

U.S. PATENT DOCUMENTS

| | | | |
|---|---|---|---|
| D. 307,814 | 5/1990 | Kawana | D34/31 |
| 2,741,514 | 4/1956 | Fisher | 414/11 |
| 3,143,219 | 8/1964 | Aldrich | 414/11 |
| 3,642,150 | 2/1972 | Zizak | 414/11 |
| 3,910,421 | 10/1975 | Panneton | 414/11 |
| 4,150,755 | 4/1979 | Trott et al. | 414/11 |
| 4,449,879 | 5/1984 | Mercer | 414/11 |
| 5,163,799 | 11/1992 | Lynn | 414/11 |
| 5,303,899 | 4/1994 | Palya | 254/334 |
| 5,640,826 | 6/1997 | Hurilla, Jr. | 414/11 X |

*Primary Examiner*—Janice L. Krizek

[57] ABSTRACT

A panel installation system is provided including a pair of side members hingably coupled with respect to a joist. Also included is at least one panel support coupled with respect to the side members along the length thereof, wherein the support defines a ledge for supporting a panel of dry wall on the side members such that the same may be lifted into a horizontal orientation.

9 Claims, 3 Drawing Sheets

ADJUSTABLE PANEL INSTALLATION ASSEMBLY

BACKGROUND OF THE INVENTION

1. Field of the Invention

The present invention relates to panel lifters and more particularly pertains to a new adjustable panel installation assembly for lifting a panel to be installed in a convenient manner without excessive labor.

2. Description of the Prior Art

The use of panel lifters is known in the prior art. More specifically, panel lifters heretofore devised and utilized are known to consist basically of familiar, expected and obvious structural configurations, notwithstanding the myriad of designs encompassed by the crowded prior art which have been developed for the fulfillment of countless objectives and requirements.

Known prior art panel lifters include U.S. Pat. No. 3,910,421; U.S. Pat. No. 4,449,879; U.S. Pat. No. 5,163,799; U.S. Pat. No. 5,303,899; U.S. Pat. No. 4,150,755; and U.S. Patent Des. 307,814.

In these respects, the adjustable panel installation assembly according to the present invention substantially departs from the conventional concepts and designs of the prior art, and in so doing provides an apparatus primarily developed for the purpose of lifting a panel to be installed in a convenient manner without excessive labor.

SUMMARY OF THE INVENTION

In view of the foregoing disadvantages inherent in the known types of panel lifters now present in the prior art, the present invention provides a new adjustable panel installation assembly construction wherein the same can be utilized for lifting a panel to be installed in a convenient manner without excessive labor.

The general purpose of the present invention, which will be described subsequently in greater detail, is to provide a new adjustable panel installation assembly apparatus and method which has many of the advantages of the panel lifters mentioned heretofore and many novel features that result in a new adjustable panel installation assembly which is not anticipated, rendered obvious, suggested, or even implied by any of the prior art panel lifters, either alone or in any combination thereof.

To attain this, the present invention generally comprises a ladder with a pair of planar rectangular side members. A plurality of rungs are coupled between the side members such that the same remain in parallel relationship. As shown in FIG. 3, a pair of planar rectangular leg extenders are each coupled to a bottom end of one of the side members of the ladder and extend downwardly therefrom in collinear relationship therewith. Also included is a pair of hinges including a pivot pin coupled between top ends of the side members of the ladder. Ends of the pivot pin extend past the side members with flanges formed thereon. As shown in FIG. 3, each hinge includes a planar rectangular tab having an inboard end with a closed loop for being hingably coupled to the pivot pin. Such coupling is preferably effected between the associated side member and flange of the pivot pin. By this structure, each tab is rotatable about the pivot pin. Each tab of the hinges further has an outboard end with a pair of bores formed therein along a central axis of the tab. In use, the bores are adapted for allowing the attachment thereof with one of a plurality of joists. Next provided is a pair of panel supports each with a generally planar rectangular configuration. The panel supports each have a periphery defined by a pair of elongated side edges and a pair of short end edges. As best shown in FIG. 5, a first one of the side edges of each panel support has an extension protruding outwardly therefrom adjacent to a first one of the end edges. The first end edge further includes a semicircular cut out formed therein. A second one of the end edges includes a square cut out formed therein and remains in communication with the second one of the side edges. During operation, the semicircular cut out is received by one of the rungs of the ladder while the square cut out is received by another adjacent rung of the ladder. As such, the extension extends past the side members of the ladder to define a ledge for supporting a panel of dry wall on the side members of the ladder. As shown in the various Figures, an adjustable support pole includes a solid upper extent having an upper end pivotally coupled to a central extent of a bottommost one of the rungs. Such pivotal coupling is effected about an axis of the bottommost rung. The support pole further includes a hollow lower extent having an open upper end for slidably receiving the upper extent. A lower end of the lower extent of the support pole is equipped with a rubber foot formed thereon. In operation, the ladder may be pivoted upwardly with the panel thereon until the panel abuts the joists. Thereafter, the support pole is pivoted into a vertical orientation for maintaining the ladder elevated and horizontally oriented. As such, the panels may be attached to the joists in a convenient manner without excessive man power.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new adjustable panel installation assembly apparatus and method which has many of the advantages of the panel lifters mentioned heretofore and many novel features that result in a new adjustable panel installation assembly which is not anticipated, rendered obvious, suggested, or even implied by any of the prior art panel lifters, either alone or in any combination thereof.

It is another object of the present invention to provide a new adjustable panel installation assembly which may be easily and efficiently manufactured and marketed.

It is a further object of the present invention to provide a new adjustable panel installation assembly which is of a durable and reliable construction.

An even further object of the present invention is to provide a new adjustable panel installation assembly which is susceptible of a low cost of manufacture with regard to both materials and labor, and which accordingly is then susceptible of low prices of sale to the consuming public, thereby making such adjustable panel installation assembly economically available to the buying public.

Still yet another object of the present invention is to provide a new adjustable panel installation assembly which provides in the apparatuses and methods of the prior art some of the advantages thereof, while simultaneously overcoming some of the disadvantages normally associated therewith.

Still another object of the present invention is to provide a new adjustable panel installation assembly for lifting a panel to be installed in a convenient manner without excessive labor.

Even still another object of the present invention is to provide a new adjustable panel installation assembly that includes a pair of side members hingably coupled with respect to a joist. Also included is at least one panel support coupled with respect to the side members along the length thereof, wherein the support defines a ledge for supporting a panel of dry wall on the side members such that the same may be lifted into a horizontal orientation.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
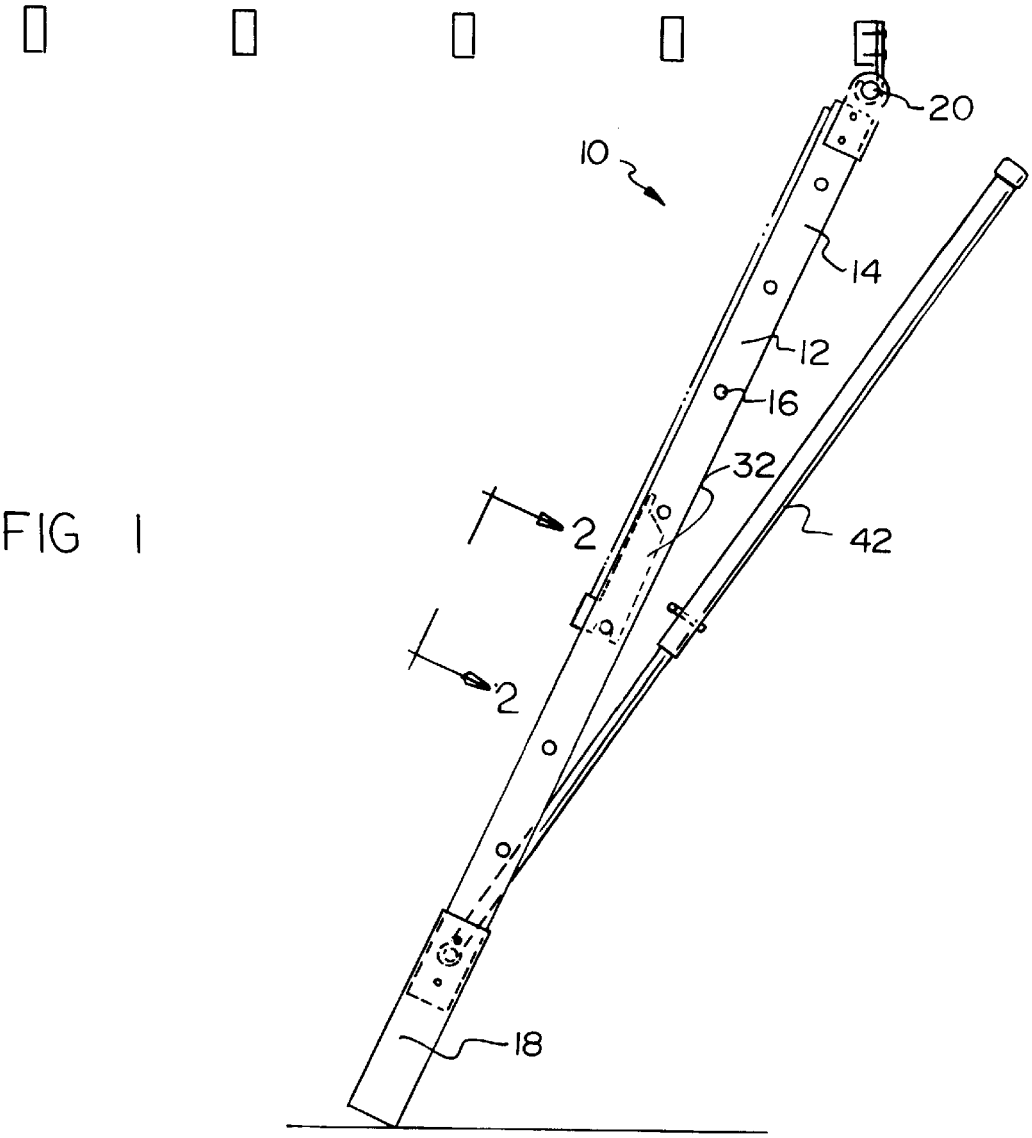
FIG. 1 is a side view of a new adjustable panel installation assembly according to the present invention.
Figure 2:
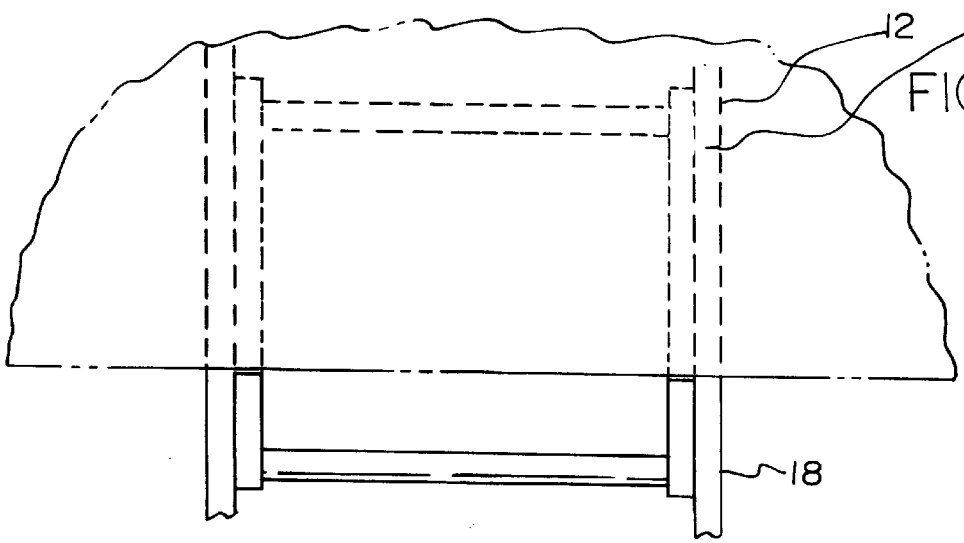
FIG. 2 is a close-up view of the panel supports of the present invention.

With reference now to the drawings, and in particular to FIGS. 1 through 5 thereof, a new adjustable panel installation assembly embodying the principles and concepts of the present invention and generally designated by the reference numeral 10 will be described.

Figure 3:
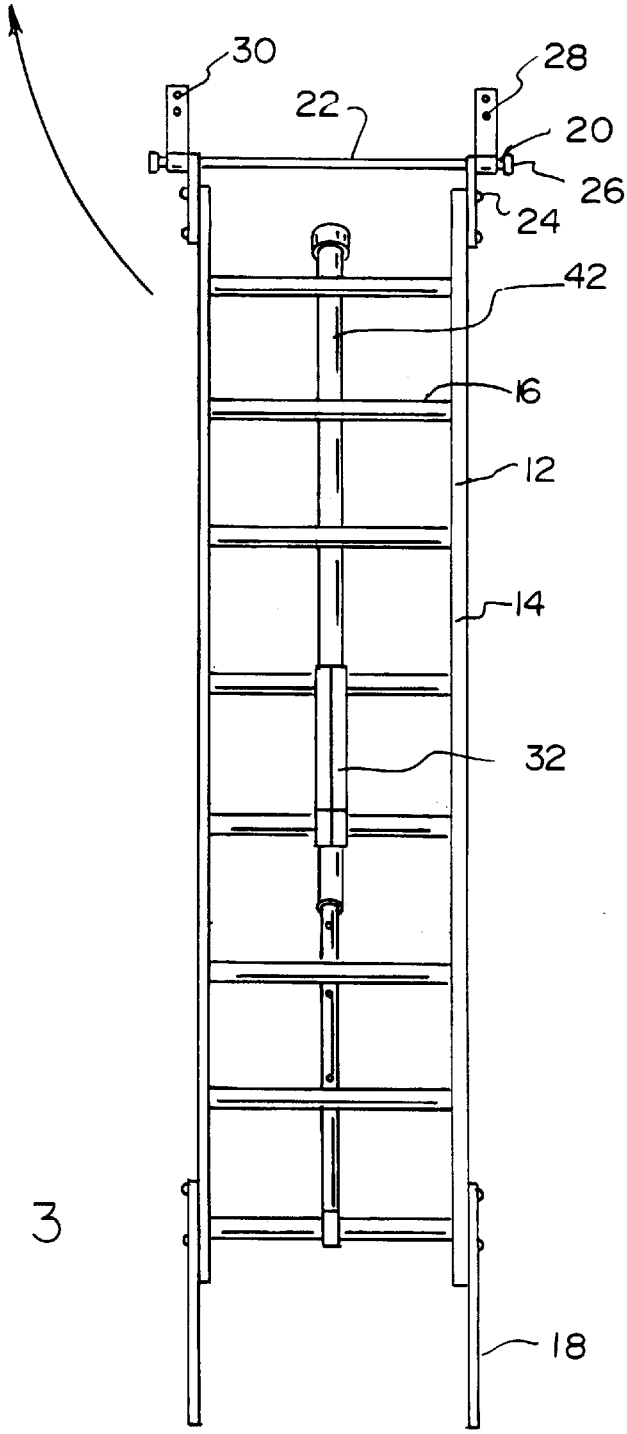
FIG. 3 is a top view of the present invention.

The present invention, designated as numeral 10, includes a ladder 12 with a pair of planar rectangular side members 14. A plurality of equally spaced rungs 16 are coupled between the side members such that the same remain in parallel relationship. As shown in FIG. 3, a pair of planar rectangular leg extenders 18 are each coupled to a bottom end of one of the side members of the ladder and extend downwardly therefrom in collinear relationship therewith. As an option, a length of the leg extenders may be adjusted by any means including, but not limited to removable bolts and linearly aligned apertures formed therein. Ideally, each leg extender extends from a bottommost one of the rungs a length about ⅛ that of the ladder.

Also included is a pair of hinges 20 including a pivot pin 22 coupled between top ends of the side members of the ladder via a pair of connectors 24. Ends of the pivot pin extend past the side members with flanges 26 formed thereon. As shown in FIG. 3, each hinge includes a planar rectangular tab 28 having an inboard end with a closed loop for being hingably coupled to the pivot pin. Such coupling is preferably effected between the associated side member and flange of the pivot pin. By this structure, each tab is rotatable about the pivot pin. Each tab of the hinges further has an outboard end with a pair of bores 30 formed therein along a central axis of the tab. In use, the bores are adapted for allowing the attachment of the corresponding hinge with one of a plurality of joists. The leg extenders may be adjusted to accommodate a height of the joists.

Figure 5:
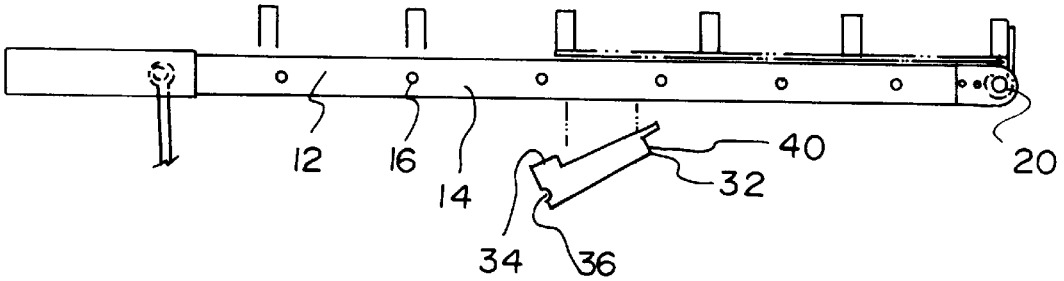
FIG. 5 is a side view of the present invention with the panel supports removed.
Figure 4A:
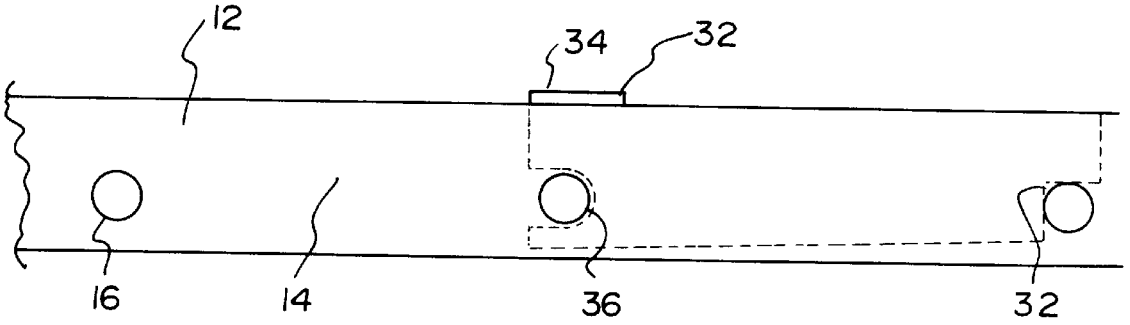
FIG. 4A is a side view of the panel supports of the present invention connected to the ladder.

Next provided is a pair of panel supports 32 each with a generally planar rectangular configuration. The panel supports each have a periphery defined by a pair of elongated side edges and a pair of short end edges. As best shown in FIG. 5, a first one of the side edges of each panel support has an extension 34 protruding outwardly therefrom adjacent to a first one of the end edges. A length of the extension is preferably about ⅙ a length of the supports. The first end edge further includes a semicircular cut out 38 formed therein. A second one of the end edges includes a square cut out 40 formed therein and remains in communication with the second one of the side edges. During operation, the semicircular cut out is received by one of the rungs of the ladder while the square cut out is received by another adjacent rung of the ladder. As such, the extension extends past the side members of the ladder to define a ledge for supporting a panel of dry wall on the side members of the ladder. It should be noted that the panel support members may be spaced with respect to each other any selected distance.

Figure 4:
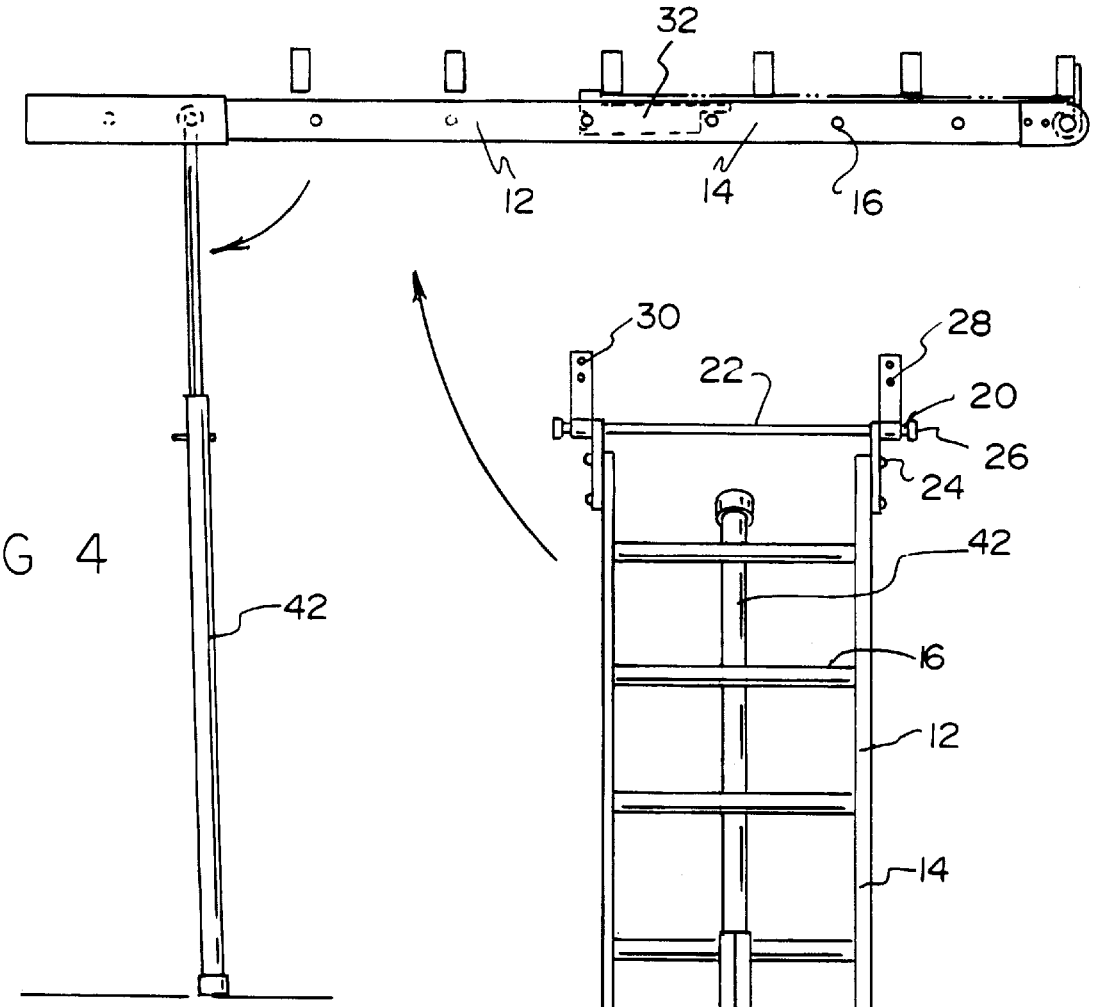
FIG. 4 is a side view of the present invention during use.

As shown in the various Figures, an adjustable support pole 42 includes a solid upper extent having an upper end pivotally coupled to a central extent of a bottommost one of the rungs. Such pivotal coupling is effected about an axis of the bottommost rung. The support pole further includes a hollow lower extent with a length similar to that of the upper extent. The lower extent has an open upper end for slidably receiving the upper extent. Length adjustability is afforded by way of a set pin which may be removably inserted within a bore of the lower extent and one of a plurality of linearly aligned bores formed in the upper extent. A lower end of the lower extent of the support pole is equipped with a rubber foot, as shown in FIG. 4.

In operation, the ladder may be pivoted upwardly with the panel thereon until the panel abuts the joists. Thereafter, the support pole is pivoted into a vertical orientation for maintaining the ladder elevated and horizontally oriented. As such, the panels may be attached to the joists in a convenient manner without excessive labor.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A ceiling panel installation system comprising, in combination:

a ladder with a pair of planar rectangular side members and a plurality of spaced apart and substantially parallel rungs extending between the side members;

a pair of planar rectangular leg extenders each coupled to a bottom end of one of the side members of the ladder and extending downwardly therefrom in collinear relationship therewith;

a pair of hinges including a pivot pin coupled between top ends of the side members of the ladder with ends extending past the side members with flanges formed thereon, each hinge including a planar rectangular tab having an inboard end hingably coupled to the pivot pin between the associated side member and flange of the pivot pin wherein each tab is rotatable about the pivot pin, each tab further having an outboard end with a pair of bores formed therein along a central axis of the tab for allowing the attachment thereof with one of a plurality of joists;

a pair of panel supports each with a generally planar rectangular configuration having a periphery defined by a pair of elongated side edges and a pair of short end edges, a first one of the side edges having an extension protruding outwardly therefrom adjacent to a first one of the end edges, the first end edge further including a semicircular cut out formed therein, a second one of the end edges having a square cut out formed therein and in communication with a second one of the side edges, wherein the semicircular cut out is received by one of the rungs of the ladder while the square cut out is received by another adjacent rung of the ladder such that the extension extends past the side members of the ladder to define a ledge for supporting a panel of dry wall on the side members of the ladder; and an adjustable support pole including a solid upper extent having an upper end pivotally coupled to a central extent of a bottommost one of the rungs about an axis of the bottommost rung, the support pole further including a hollow lower extent having an open upper end slidably receiving the upper extent and a lower end with a rubber foot formed thereon;

wherein the ladder may be pivoted upwardly with the panel thereon until the panel abuts the joists whereafter the support pole is pivoted into a vertical orientation for maintaining the ladder elevated and horizontally oriented so that the panel may be attached to the joists.

2. A panel installation system comprising:

a pair of side members hingably coupled with respect to a joist;

a plurality of rungs being extended between the side members;

at least one panel support coupled with respect to the side members along the length thereof, the panel support having a pair of opposite end edges and a pair of side edges, a first of the side edges having an extension protruding outwardly therefrom, a first of the end edges having a first cutout formed therein, a second of the end edges having a cutout formed therein and in communication with a second of the side edges, wherein the first cutout receives one of the rungs and the second cutout receives another adjacent rung such that the extension extends past the side members to define a ledge for supporting a planar panel on the side members such that the panel may be elevated into a horizontal orientation.

3. A panel installation system as set forth in claim 2 wherein the plurality of rungs are arranged in a row extending between opposite ends of the side members, and wherein the rungs are spaced apart at generally equal intervals in the row.

4. A panel installation system as set forth in claim 2 and further including a support pole having a top end pivotally coupled with respect to the side members.

5. A panel installation system as set forth in claim 4 wherein the support pole has an adjustable length.

6. A panel installation system as set forth in claim 2 wherein the at least one panel support is removable.

7. A panel installation system as set forth in claim 2 wherein the at least one panel support is adjustably coupled with respect to the side members along the length thereof.

8. A panel installation system as set forth in claim 2 wherein a length of the side members is adjustable.

9. A panel installation system, comprising:

a ladder having a spaced apart pair of elongate side members extending substantially parallel to one another, and at least three rungs extending between the side members and arranged in a row extending between opposite ends of the side members, the rungs being spaced apart at generally equal intervals in the row;

each of the side members having a first end adapted for pivotably coupling to a joist; and at least one panel support having a pair of opposite end edges and a pair of side edges, a first of the side edges having an extension protruding outwardly therefrom, a first of the end edges having a first cutout formed therein, a second of the end edges having a cutout formed therein and in communication with a second of the side edges, wherein the first cutout receives one of the rungs and the second cutout receives an adjacent rung such that the extension extends past the side members of the ladder to define a ledge for supporting a planar panel on the side members.

* * * * *